United States Patent [19]

Donahue et al.

[11] Patent Number: 5,038,847

[45] Date of Patent: Aug. 13, 1991

[54] EVAPORABLE FOAM PATTERN FOR USE IN CASTING A CRANKSHAFT

[75] Inventors: Raymond J. Donahue, Fond du Lac; William G. Hesterberg, Rosendale; Terrance M. Cleary, Allenton, all of Wis.

[73] Assignee: Brunswick Corporation, Skokie, Ill.

[21] Appl. No.: 438,936

[22] Filed: Nov. 16, 1989

Related U.S. Application Data

[63] Continuation of Ser. No. 238,542, Aug. 30, 1988, abandoned.

[51] Int. Cl.[5] ..... B22C 9/04; B22D 19/02

[52] U.S. Cl. ..... 164/112; 164/34; 164/246; 164/249

[58] Field of Search ..... 164/34, 35, 36, 45, 164/246, 249, 98, 112

[56] References Cited

U.S. PATENT DOCUMENTS 4,691,754 9/1987 Trumbauer et al. ..... 164/34
4,705,092 11/1987 Ito et al. ..... 164/34

FOREIGN PATENT DOCUMENTS 43-19001 8/1968 Japan ..... 164/112
61-176461 8/1986 Japan ..... 164/98

*Primary Examiner*—Richard K. Seidel
*Attorney, Agent, or Firm*—Andrus, Sceales, Starke & Sawall

[57] ABSTRACT

A pattern for use in casting a rotatable shaft, such as a crankshaft for an internal combustion engine. The pattern includes an evaporable foam pattern section composed of a material such as polystyrene and having a configuration conforming to the crankshaft to be cast. The evaporable foam pattern section includes a plurality of cranks connected by bearing areas, and tubular metal inserts formed of bearing quality steel are disposed around each bearing area and around the pin areas of the cranks. In the casting process, the pattern is placed in a mold and surrounded with a finely divided material such as sand. When molten ferrous metal is fed into contact with the pattern, the pattern will vaporize with the vapor passing into the interstices of the sand while the molten ferrous metal will occupy the void created by the vaporized foam to produce a cast crankshaft having bearing quality steel inserts at the bearing and pin areas.

11 Claims, 1 Drawing Sheet

EVAPORABLE FOAM PATTERN FOR USE IN CASTING A CRANKSHAFT

This is a continuation of application Ser. No. 238,542, filed Aug. 30, 1988, now abandoned.

BACKGROUND OF THE INVENTION

To operate a crankshaft of a two cycle engine at high speed and not generate excessive heat, needle bearings are commonly used against the pins and main bearing surfaces of the crankshaft. It has been the practice in the past to forge crankshafts of a two cycle engine from low carbon steel, containing from 0.1 to 0.2% carbon. As the low carbon steel does not have sufficient strength to withstand the high contact loads encountered at the bearing and pin surfaces, it has been the practice to carburize the forged crankshaft and then machine the bearing and pin surfaces to final tolerance. Due to the forging, carburizing and machining operations, the crankshaft is an expensive component of the engine.

Evaporable foam casting procedures have been used in casting engine blocks and other components for internal combustion engines. In the normal evaporable foam casting process, a pattern is molded from a material, such as polystyrene, and has a configuration identical to the metal part to be cast. The pattern is placed in a mold and a flowable medium, such as sand, surrounds the pattern and fills the cavities of the pattern. A molten metal is then introduced via a sprue to the pattern and the heat of the molten metal will vaporize the pattern with the vapor being entrapped within the intersticies of the sand while the molten metal will occupy the void created by vaporization of the pattern. The result is a cast metal part having a configuration identical to the evaporable foam pattern.

SUMMARY OF THE INVENTION

The invention is directed to a pattern for use in casting a ferrous crankshaft for an internal combustion engine. The pattern is composed of an evaporable foam pattern section, formed of a material such as polystyrene, and having a configuration conforming to the crankshaft to be cast. The evaporable foam pattern section includes a plurality of cranks connected by bearing areas and cylindrical metal inserts formed of bearing quality steel are disposed around each bearing area and around the pin areas of the cranks. The outer diameter of each metal insert is finished to a final tolerance dictated by the variability of spacial as cast location of the insert.

In the casting process, the pattern, including the evaporable foam pattern section and the metal inserts, is placed in a mold and surrounded by a flowable material such as sand. A molten ferrous metal, such as cast iron or steel, is then fed through a sprue into contact with the pattern and the heat of the molten metal will vaporize the foam pattern section, with the vapor being trapped in the intersticies of the sand while the molten ferrous metal will occupy the void created by vaporization of the foam material. The resulting cast crankshaft has a core of cast iron or steel with integral bearing quality steel tubular inserts at the bearing and pin areas.

With the method of the invention, the crankshaft has bearing quality steel in the critical bearing and pin areas. As the remainder of the crankshaft is formed from less expensive ferrous metal, and as no carburizing or machining of the bearing and pin areas is required, the crankshaft construction is considerably less expensive than the normal forged and carburized crankshafts forged of bearing quality steel.

The use of cast iron as the core material has an advantage in that cast iron will expand on solidification to thereby provide a tight, secure joint between the cast iron core and the bearing quality steel inserts.

If for some reason the pattern, including the evaporable foam section and the metal inserts, is not within required tolerance, the pattern can be scrapped with minimum loss. On the other had, if a forged steel crankshaft is found for some reason to be out of tolerance, the entire forged crankshaft must be scrapped.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
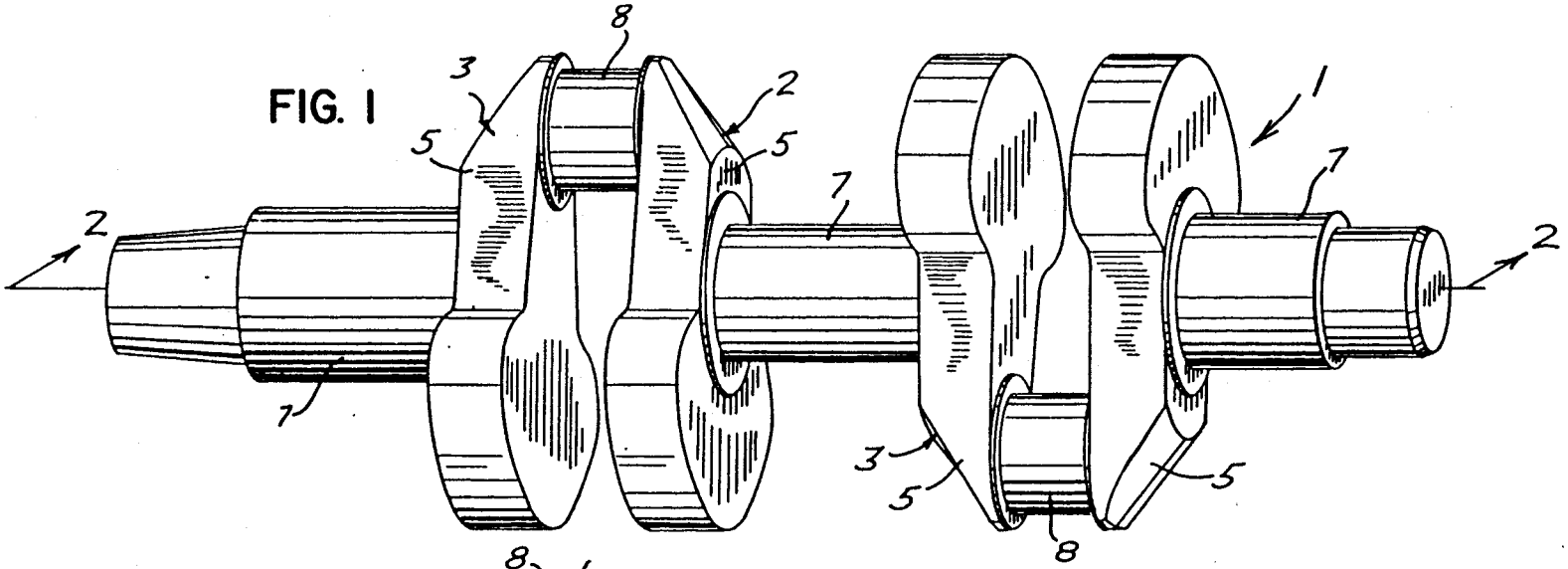
FIG. 1 is a perspective view of the crankshaft pattern.
Figure 2:
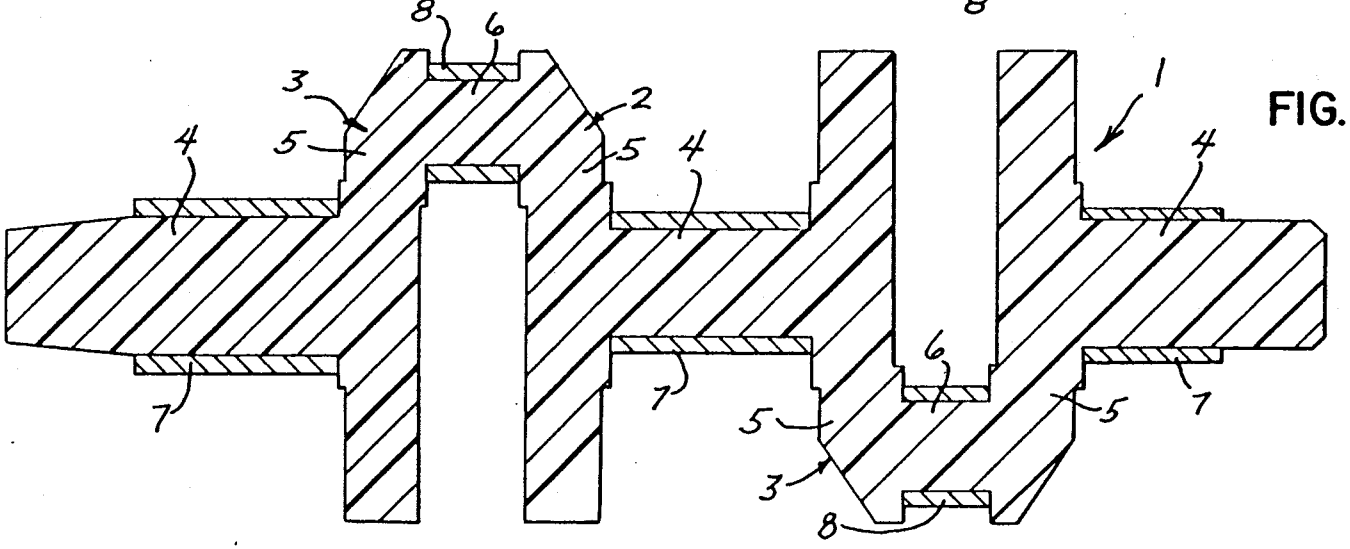
FIG. 2 is a longitudinal section of the pattern.

The drawings illustrate a pattern 1 to be used in casting a crankshaft for an internal combustion engine, such as a two cycle engine. The pattern 1 has a configuration identical to the metal crankshaft to be cast, and therefore in describing the pattern reference will be made to the components of the crankshaft itself.

Pattern 1 includes a pattern section 2 formed of an evaporable foam material such as polystyrene. Pattern section 2 includes a pair of cranks 3 which are connected by axially aligned bearing areas 4.

Each crank 3 includes a pair of spaced parallel crank arms 5 which are connected at their extremities by pin areas 6.

Pattern 1 also includes cylindrical metal inserts 7, which surround the bearing areas 4, and cylindrical metal inserts 8 which surround the pin areas 6. The outer diameters of inserts 7 and 8 are machined or otherwise finished to the desired final tolerance.

Inserts 7 and 8 are formed of a metal, such as steel, that meets bearing quality standards such as described in ASTH 534.

The evaporable foam pattern section 2 is molded ty a conventional injection molding process and the metal inserts 7 and 8 are positioned within the mold so that the foam material is integrally molded to the inserts.

In the casting procedure for forming the ferrous crankshaft, the pattern 1, including the evaporable foam pattern section 2 and the metal inserts 7 and 8, is placed in a mold and the pattern is surrounded by a flowable finely divided material, such as sand. A molten ferrous material, such as cast iron or steel, is fed to the pattern through a sprue and the heat of the molten metal will vaporize the pattern section 2 with the vapor passing into the intersticies of the sand while the molten metal will occupy the voids created by vaporization of the pattern section 2. The resulting cast crankshaft consists of a core, having a configuration identical to pattern section 2 and formed of the ferrous metal such as cast iron, and having bearing quality steel inserts 7 and 8 at the bearing and pin areas.

With the invention the crankshaft can be cast from a relatively inexpensive metal, such as cast iron or low carbon steel containing from 0.1 to 0.2% by weight of carbon, which in itself would not be suitable to withstand the high contact loads encountered at the bearing and pin areas. The use of cast iron in producing the crankshaft has the advantage that the cast iron will expand on solidification to provide a tight joint with the inserts 7 and 8.

Due to the fact that the outer diameters of the inserts 7 and 8 are finished to the desired final tolerance, no machining of the cast crankshaft is required. Further, the invention eliminates the expensive carburizing process that was formerly required with forged crankshafts.

While the invention has particular application to producing a crankshaft for a two cycle engine, it also has application in producing other shafts or rotatable members having bearing areas.

Various modes of carrying out the invention are contemplated as being within the scope of the following claims particularly pointing out and distinctly claims the subject matter which is regarded as the invention.

We claim:

1. A method of casting a metal shaft, comprising the steps of forming an evaporable foam pattern section having a configuration conforming to the shaft to be cast and including a cylindrical bearing area, locating a tubular cylindrical metal insert around said bearing area to provide a pattern, positioning said pattern in a mold and introducing a flowable finely divided material around said pattern and said insert, and feeding a molten ferrous metal into contact with the pattern to vaporize said evaporable foam pattern section with the vapor passing into the interstices of the flowable material and said molten ferrous metal occupying the void created by vaporization of said pattern section to provide a ferrous metal shaft having a metal insert at said bearing area.

2. A method of casting a metal crankshaft for an engine, comprising the steps of forming an evaporable foam crankshaft pattern having a configuration conforming to the crankshaft to be cast and consisting of at least one crankshaft and a plurality of bearing areas connected to said crank, said crank including a pair of parallel arms connected by a pin area, locating hardened tubular metal inserts around said bearing areas and around said pin area to provide a composite pattern structure, positioning said composite pattern structure in a mold, introducing a finely divided unbonded flowable material around the pattern and the inserts in the mold, and feeding a molten ferrous metal into contact with the pattern to vaporize the evaporable foam material with the vapor being entrapped within the interstices in the flowable material and said molten ferrous metal occupying the void created by vaporization of said pattern to provide a cast ferrous metal crankshaft having integral hardened metal inserts at the bearing and pin areas.

3. The method of claim 2, wherein said evaporable foam material is polystyrene.

4. The method of claim 2, wherein said tubular metal inserts are composed of bearing quality steel.

5. The method of claim 2 wherein said molten ferrous metal is cast iron.

6. The method of claim 2, and including the step of fabricating the outer diameter of said metal inserts to a predetermined tolerance before locating said inserts around said bearing and pin areas.

7. A method of casting a ferrous metal crankshaft for an engine, comprising the steps of forming a crankshaft pattern section of polystyrene, said pattern section consisting of a plurality of cranks connected by bearing areas, each crank including a pair of parallel arms connected by a pin area, locating tubular metal inserts composed of bearing quality steel around each bearing area and around each pin area to provide a composite pattern, positioning the pattern in a mold, introducing a flowable finely divided material into the mold to surround said pattern section and said inserts, and feeding molten cast iron into contact with the pattern to vaporize said polystyrene, with the vapor being entrapped in the interstices of the flowable material and said molten cast iron occupying the void created by vaporization of said polystyrene pattern section to provide a cast iron crankshaft having bearing quality steel inserts at the bearing and pin areas.

8. An assembly for casting a metal crankshaft for an engine, comprising an evaporable foam pattern having a configuration conforming to the crankshaft to be cast and including at least one cylindrical bearing area, a cylindrical metal insert disposed around the outer surface of said bearing area, and a finely divided flowable material disposed around said pattern and around said insert, feeding of a molten ferrous metal into contact with the pattern acting to vaporize said pattern with the vapor passing into the interstices of the flowable material and said molten ferrous metal occupying the void created by vaporization of said pattern to provide a ferrous metal shaft having a metal insert at said bearing area.

9. The pattern of claim 8, wherein each cylindrical insert is composed of bearing quality steel.

10. The pattern of claim 8, and including a plurality of cranks with said bearing areas disposed between adjacent cranks.

11. The pattern of claim 8, wherein said evaporable foam pattern section is composed of polystyrene.

* * * * *